US009372055B2

(12) United States Patent
Won et al.

(10) Patent No.: US 9,372,055 B2
(45) Date of Patent: Jun. 21, 2016

(54) PASSIVE CONTROL FIN STOPS FOR AIR LAUNCHED BOOSTED (TWO STAGE) HIGH SPEED VEHICLES

(71) Applicant: The Boeing Company, Chicago, IL (US)

(72) Inventors: Ben YoungSon Won, Hungtington Beach, CA (US); Marvin Luke, La Mirada, CA (US); Daniel Madrid Ortega, Huntington Beach, CA (US); Creed E. Blevins, Aliso Viegjo, CA (US)

(73) Assignee: The Boeing Company, Chicago, IL (US)

( * ) Notice: Subject to any disclaimer, the term of this patent is extended or adjusted under 35 U.S.C. 154(b) by 141 days.

(21) Appl. No.: 14/170,143

(22) Filed: Jan. 31, 2014

(65) Prior Publication Data

US 2015/0247712 A1 Sep. 3, 2015

(51) Int. Cl.

| | |
|---|---|
| ***F42B 10/06*** | (2006.01) |
| ***F42B 10/04*** | (2006.01) |
| ***F42B 10/64*** | (2006.01) |

(52) U.S. Cl.

CPC ..... *F42B 10/06* (2013.01); *F42B 10/04* (2013.01); *F42B 10/64* (2013.01); *Y10T 29/49826* (2015.01)

(58) Field of Classification Search

CPC ..... F42B 10/64; F42B 10/62; F42B 10/06; F42B 10/20; F42B 10/14; F42B 10/04; F42B 15/36; F42B 15/38; F42B 15/105; F42B 15/10; F42B 15/01; F41F 3/052

See application file for complete search history.

(56) References Cited

U.S. PATENT DOCUMENTS

| | | | | |
|---|---|---|---|---|
| 4,607,810 | A * | 8/1986 | Frazer | 244/3.29 |
| 5,823,469 | A * | 10/1998 | Arkhangelsky et al. | 244/3.22 |
| 6,186,443 | B1 * | 2/2001 | Shaffer | 244/3.29 |
| 6,450,444 | B1 * | 9/2002 | Sorvino | 244/3.24 |
| 6,772,693 | B2 * | 8/2004 | Kuru et al. | 102/293 |
| 8,387,508 | B2 * | 3/2013 | Niemi et al. | 102/293 |
| 2014/0008483 | A1 * | 1/2014 | Valledor et al. | 244/3.27 |

FOREIGN PATENT DOCUMENTS

| | | | | |
|---|---|---|---|---|
| GB | 2077399 A | * | 12/1981 | F42B 10/14 |

* cited by examiner

*Primary Examiner* — Tien Dinh
*Assistant Examiner* — Richard R Green
(74) *Attorney, Agent, or Firm* — Felix L. Fischer

(57) ABSTRACT

A temporary control fin stop system employs a housing coupled to a vehicle. At least one tang is coupled to the housing and positioned to engage a trailing edge of a fin. The tang is ablatively erodible at a predetermined temperature induced by a flight profile of the vehicle to allow unconstrained motion of the fin.

18 Claims, 10 Drawing Sheets

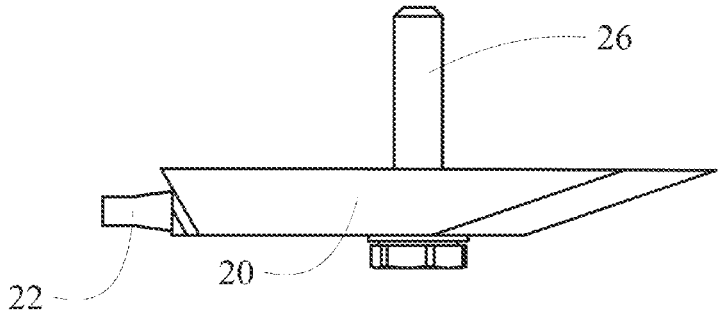
FIG. 5
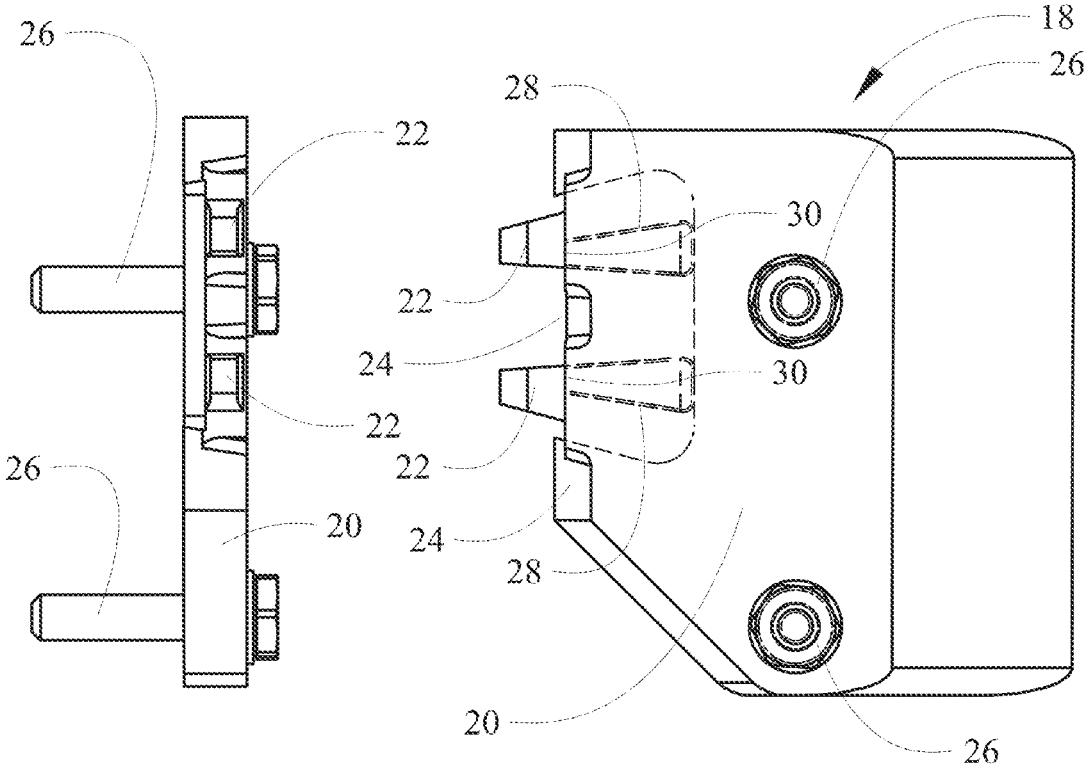
FIG. 4
FIG. 3

PASSIVE CONTROL FIN STOPS FOR AIR LAUNCHED BOOSTED (TWO STAGE) HIGH SPEED VEHICLES

STATEMENT REGARDING FEDERALLY SPONSORED RESEARCH OR DEVELOPMENT

This invention was made with Government support under (F33615-03-9-2422) awarded by the Department of Defense. The government has certain rights in this invention

BACKGROUND INFORMATION

1. Field

Embodiments of the disclosure relate generally to aerodynamic surface locking systems and more particularly to embodiments for a physical control lock to prevent undesirable motion of an aerodynamic surface during a boosted launch with ablative erosion of the locking elements to release the surface and lock geometry for break free operation upon powering of surface controls.

2. Background

Launch of boosted two stage vehicles from a carrier aircraft may be somewhat forceful in order to achieve successful and safe separation from the carrier aircraft. Control surfaces on the vehicle are typically unpowered during launch and the surfaces must be maintained in a neutral or defined position to avoid inadvertent cocking at angles which might cause uncontrollable flight or inadvertent striking of the carrier aircraft with attendant crew safety issues. Mechanical control locks typically require a complex mechanism for activation and may provide an additional failure mode. Frangible locks or pyrotechnically disengaged locks may produce debris pieces which are large enough to be a potential hazard to the vehicle.

It is therefore desirable to provide a structurally simple and cost effective control locking system which maintains control of the aerodynamic surface until control system power is applied. Additionally, it is desirable to provide reliable disengagement of the locking system at a predetermined flight phase.

SUMMARY

Exemplary embodiments provide a temporary control fin stop system employing a housing coupled to a vehicle. At least one tang is coupled to the housing and positioned to engage a trailing edge of a fin. The tang is ablatively erodible at a predetermined temperature induced by a flight profile of the vehicle to allow unconstrained motion of the fin.

The embodiments provide a method for constraining an unpowered control fin by attaching a housing to a booster exterior surface and inserting stop tangs into the housing to extend for contact with a control fin. The stop tangs are then ablatively eroded to allow unconstrained motion of the control fin.

The features, functions, and advantages that have been discussed can be achieved independently in various embodiments of the present invention or may be combined in yet other embodiments further details of which can be seen with reference to the following description and drawings.

BRIEF DESCRIPTION OF THE DRAWINGS

FIG. 3 is a detailed side view of the exemplary embodiment;

FIG. 4 is a detailed front view of the exemplary embodiment;

FIG. 5 is a top view of the exemplary embodiment;

DETAILED DESCRIPTION

The embodiments described herein provide a passive control fin stop system for precluding unwanted motion of a control fin during a launch sequence of an air vehicle such as an air launched, boosted, two stage high speed vehicle. The control fin stops incorporate a dimensionally stable housing fabricated in metal or carbon matrix composite (CMC) and finger like protrusion that inhibit control fin movement. The finger like protrusions referred to herein as tangs have a material composition selected based upon the launch and initial boost phase environments of the flight. The selection of the tang material utilizes low temperature material properties seen at high altitudes to restrain unpowered control fin movement prior to launch while providing a low melt point to erode/ablate from aerodynamic heating during the boost phase of the vehicle flight. The control fin stop tang material and shape are designed to be passive and failsafe. The passive control fin stops arrests fin motion under aerodynamic load and random vibration in case of inadvertent control fin locking mechanism failure. The control fin stop tangs melt away before the fin is commanded. However, the control fin stops also yield at room temperature to be sheared by a powered/commanded control fin and do not impede the functionality of a powered actuator.

Figure 1:
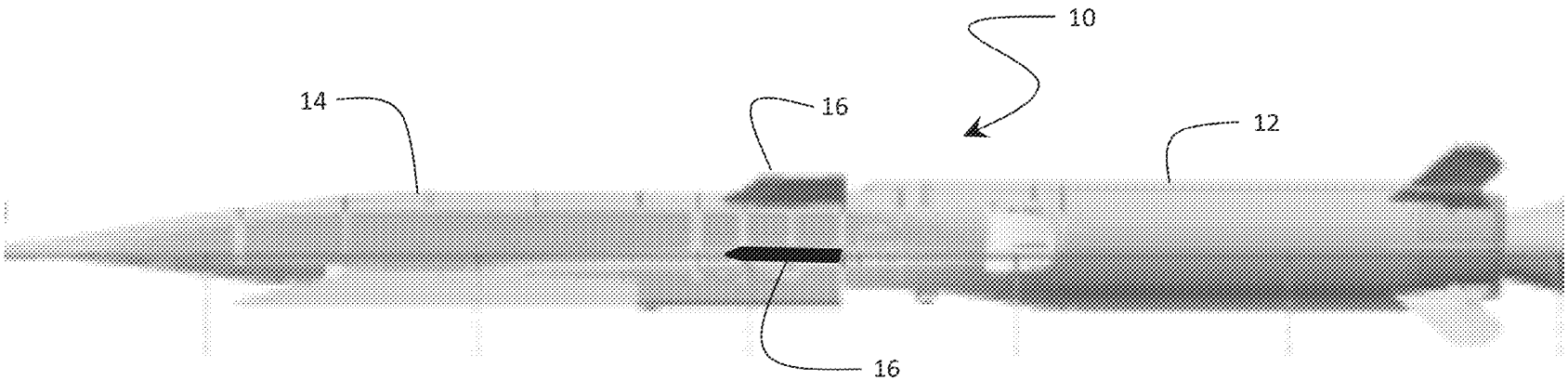
FIG. 1 is a side view of an exemplary air vehicle on which the present embodiments may be employed.
Figure 2:
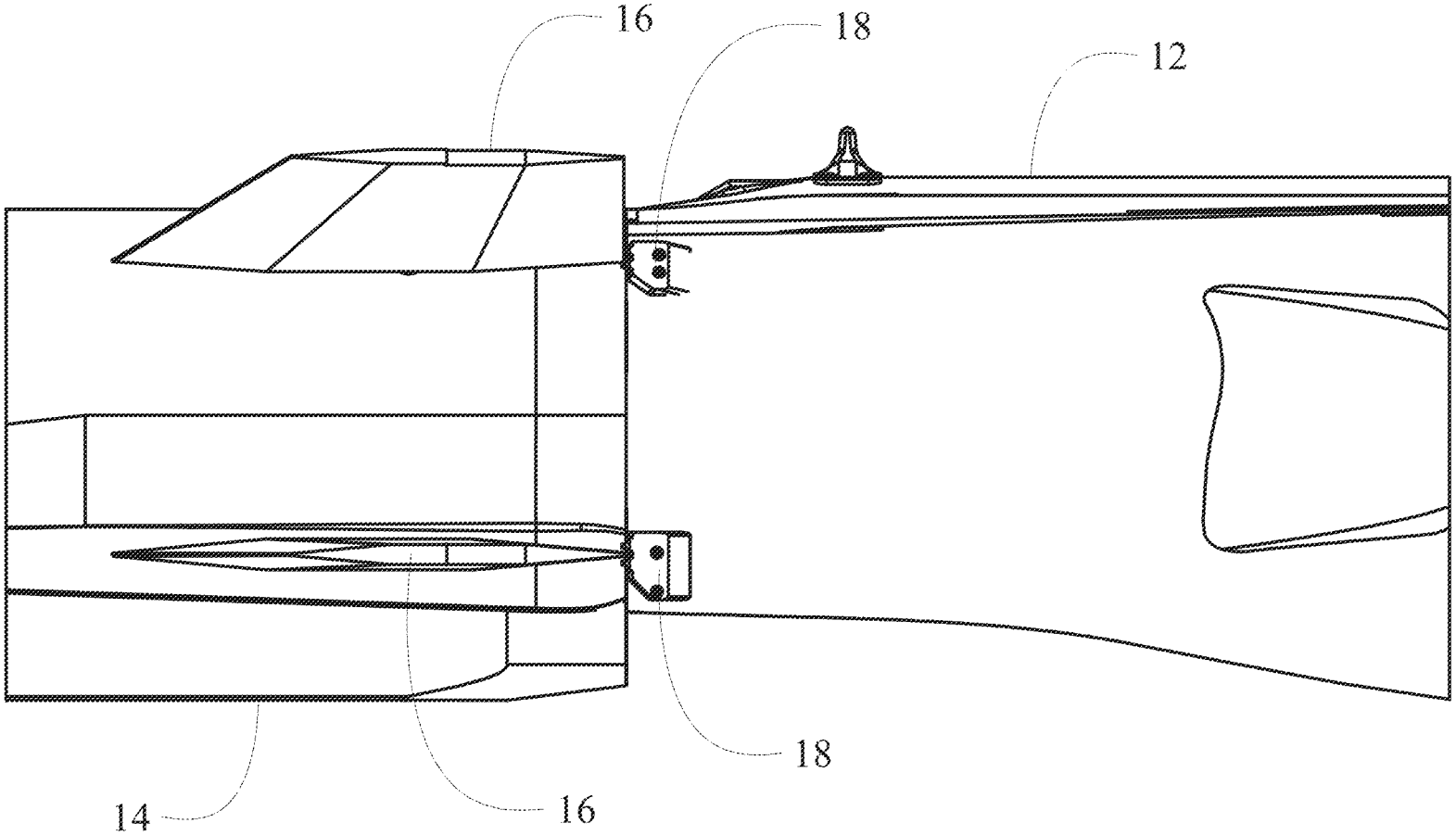
FIG. 2 is a partial side view of the air vehicle of FIG. 1 showing details of and installation of an exemplary embodiment.

Referring to the drawings, FIG. 1 shows an exemplary air vehicle 10 on which the embodiments to be described herein may be employed. Air vehicle 10 is a multistage test vehicle having a booster 12 and a hypersonic primary vehicle 14. The primary vehicle 14 has one or more control fins 16 for aerodynamic control. As shown in FIG. 2, a control fin stop assembly 18 is attached to the booster 12, as will be described in greater detail subsequently, to engage each control fin 16.

Figure 6:
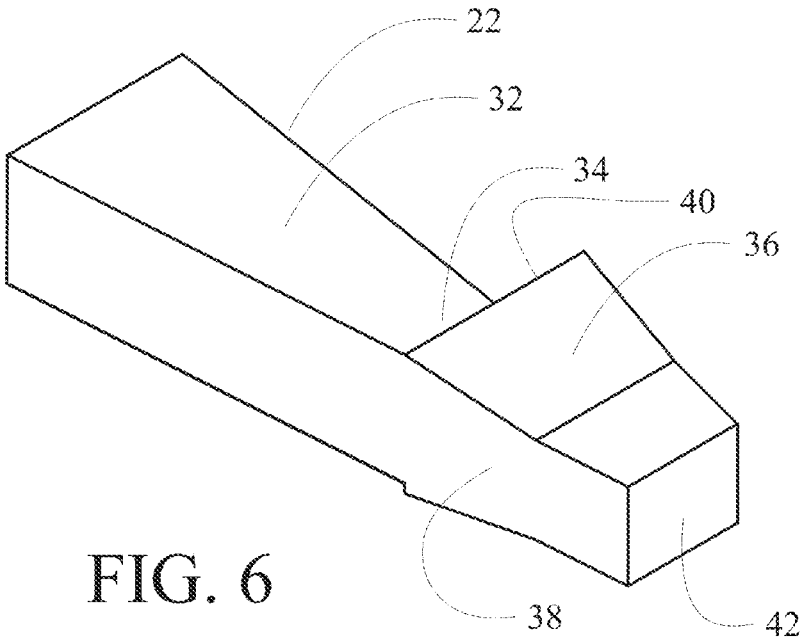
FIG. 6 is a detailed isometric view of a stop tang employed in the exemplary embodiment.
Figure 8:
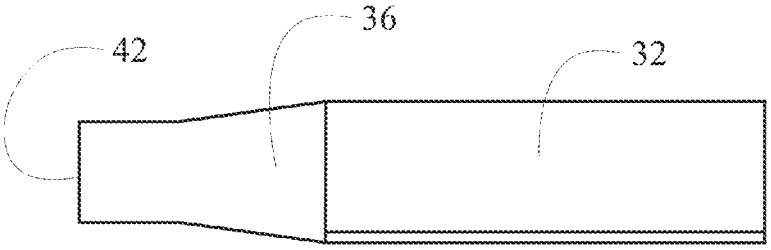
FIG. 8 is a top view of the stop tang.
Figure 9:
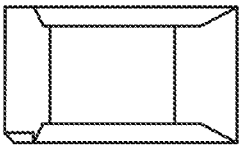
FIG. 9 is a front view of the stop tang.
Figure 7:
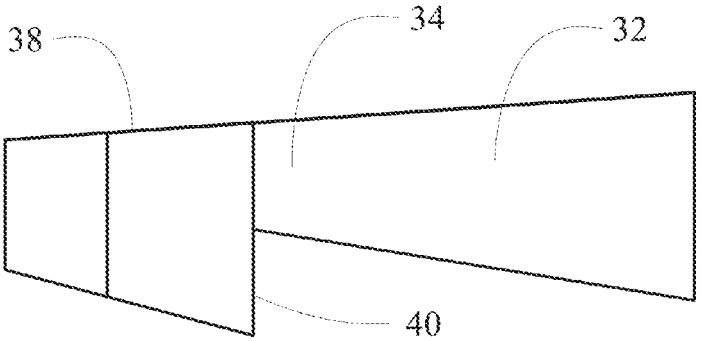
FIG. 7 is a side view of the stop tang.

The control fin stop assembly 18 is shown in detail in FIGS. 3-5. A housing 20 is employed for attachment to the booster 12. A pair of tangs 22 extend from a forward surface 24 on the housing 20. For the embodiment shown, the housing 20 is attached to the booster 12 using bolts 26. Each stop tang 22 is coupled to the housing by engaging a portion of the tang in a relief or shaped cutout 28 in the housing. For the exemplary embodiment, each cutout 28 has a trapezoidal shape with a narrow side opening 30 onto the forward surface 24. Details of exemplary stop tangs 22 are shown in FIGS. 6-9. Each stop tang 22 has a body 32 shaped to be received in the cutout 28 in the housing 20. The trapezoidal shape of the body 32 prevents the tang from being withdrawn axially from the cutout 28 through the narrow side opening 30. A narrow end 34 of the body 32 provides a neck on which a contact head 36 is attached. As seen in FIGS. 3 and 5, the contact head 36 extends forward of the forward surface 24 on the housing and provides a contacting surface 38 for the control fin as shown in FIGS. 6 and 7. A reaction surface 40 is provided on the contact head 36 which engages the forward surface 24 of the housing 20. Force exerted by a control fin acting on the contacting surface 38 of the cantilevered head 36 urges rotation of the head on the neck 34. Reaction surface 40 acting on the forward surface 24 prevents rotation of the head 36 substantially resolving any rotational forces imparted by the control fin into shear across the neck 34. Head 36 has a blunt forward end 42 and the head tapers from the neck as seen in FIGS. 6, 8 and 9 to reduce volume of the head; both attributes enhancing the ability for ablative erosion of the head to free the control fin as will be described in greater detail subsequently.

Figure 10:
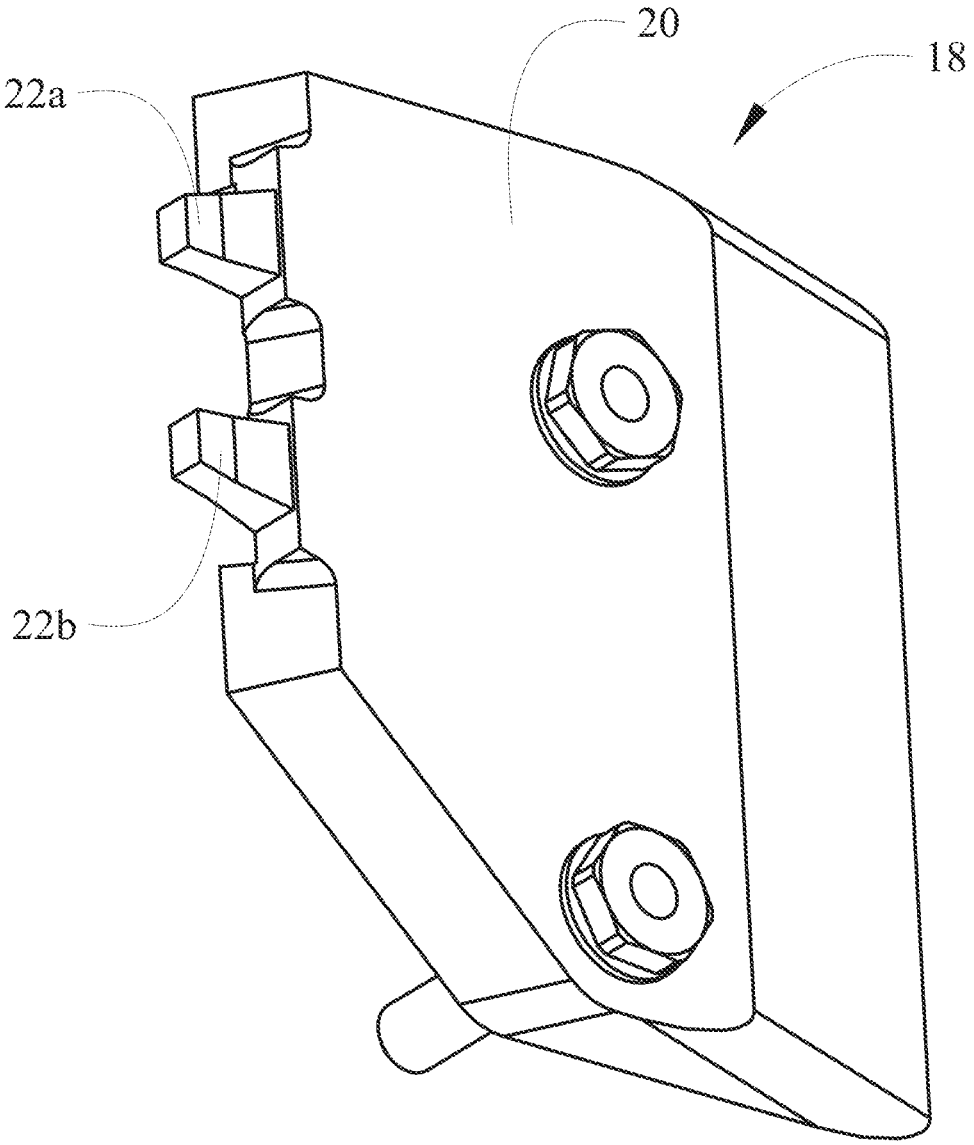
FIG. 10 is an isometric view of the exemplary embodiment.
Figure 11:
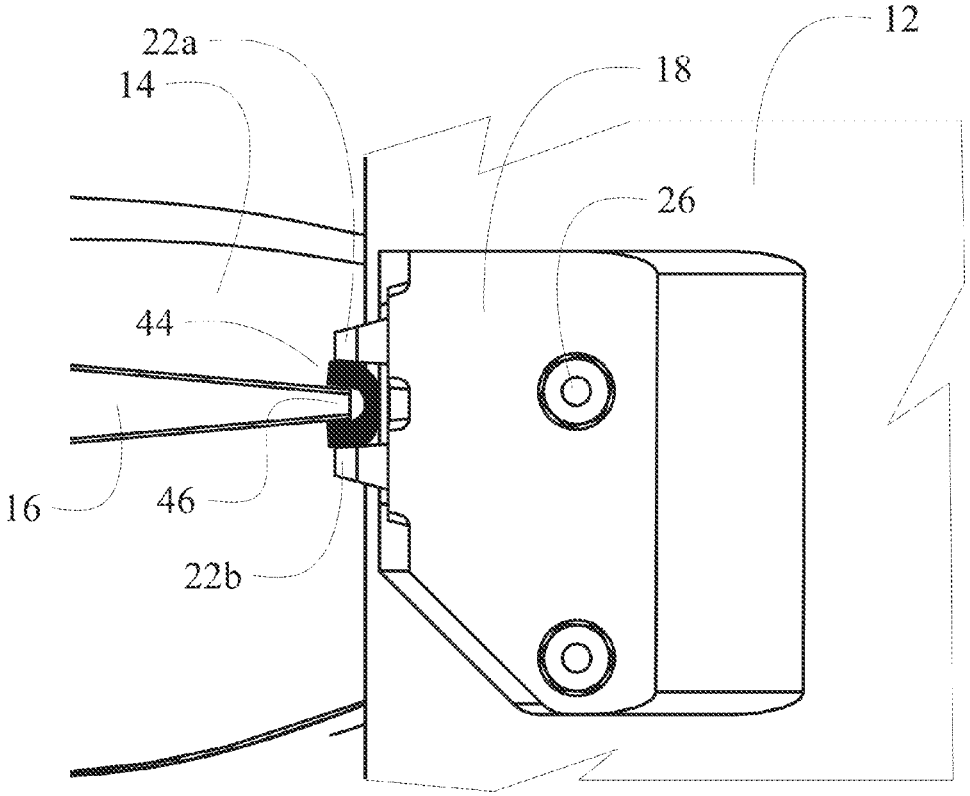
FIG. 11 is a detailed side view of the exemplary embodiment of the control fin stop assembly with a match drill tool installed for spacing of the stop tangs and fin.
Figure 12:
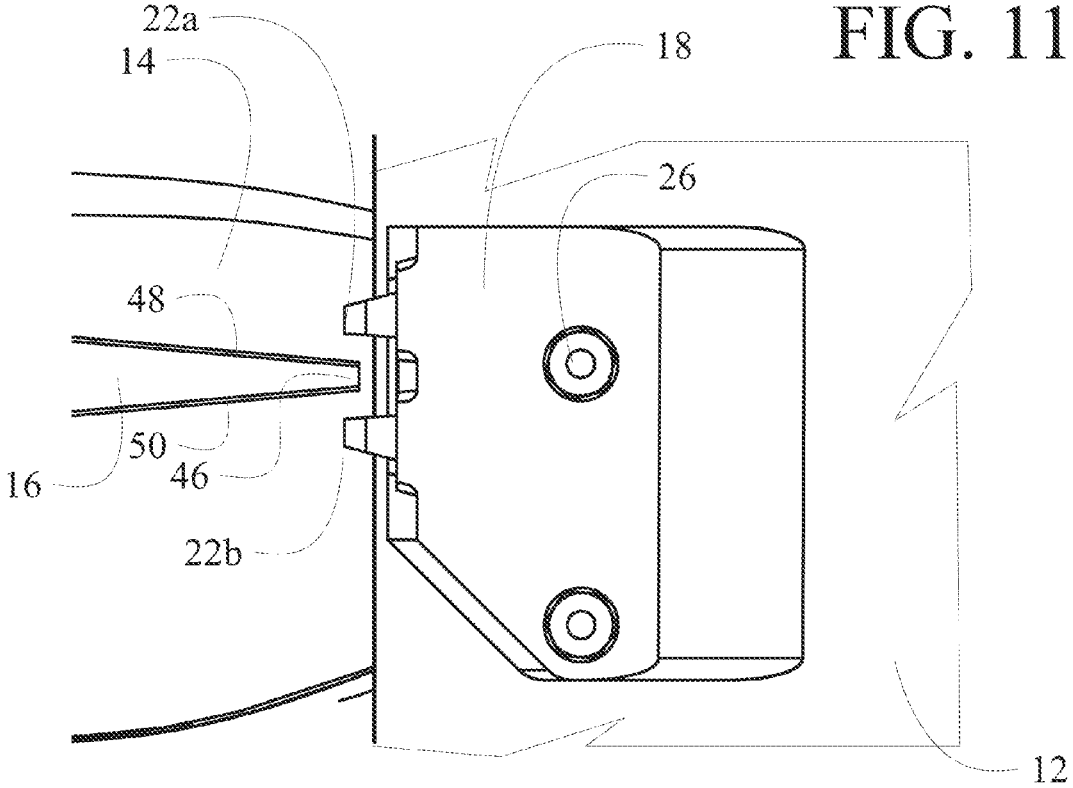
FIG. 12 is a detailed side view of the exemplary embodiment with a match drill tool removed after installation of the control fin stop assembly.
Figure 13:
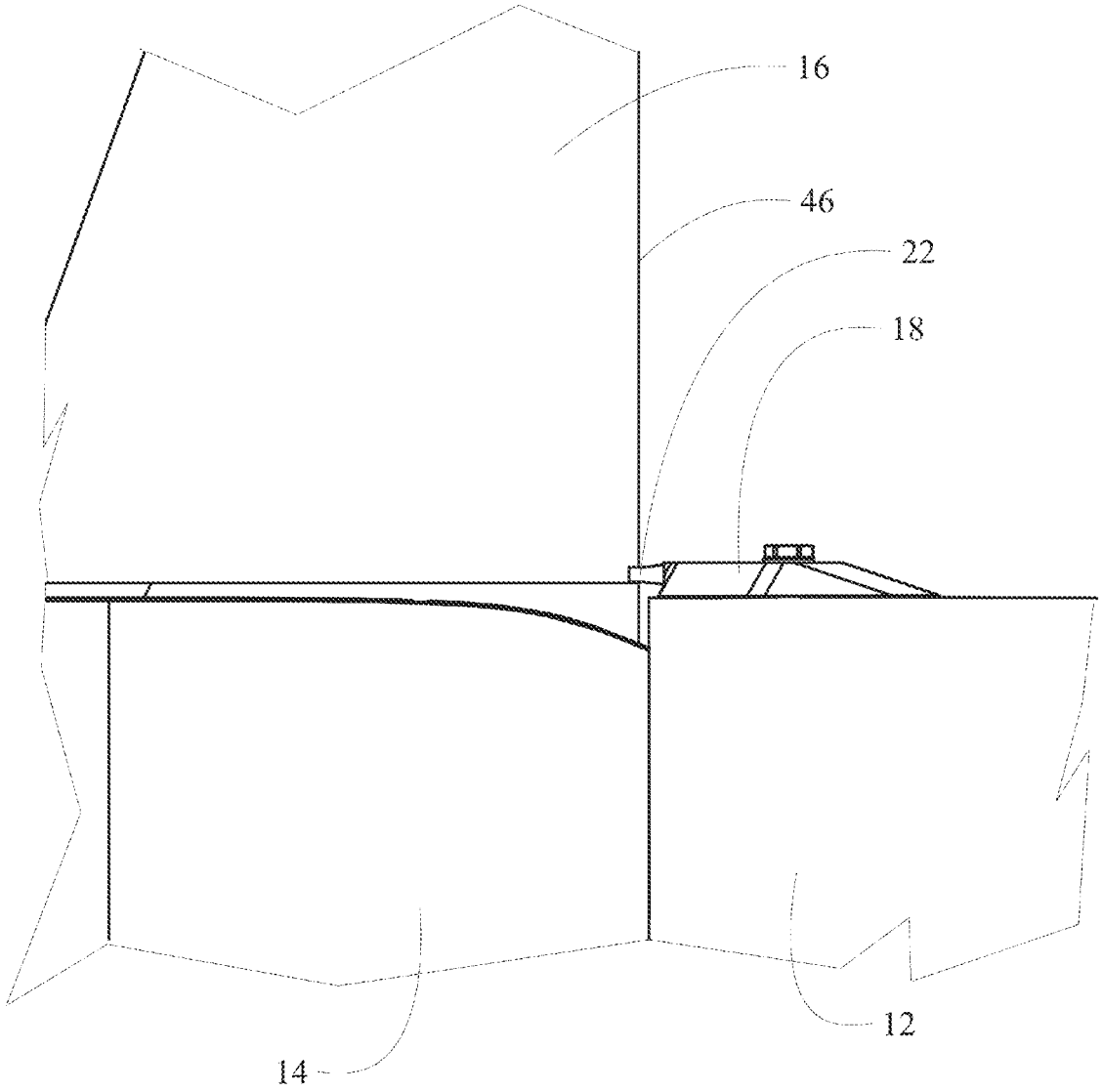
FIG. 13 is a bottom view of the installed control fin stop assembly engaging the fin.

The assembled control fin stop assembly 18 as shown in FIG. 10 provides opposing stop tangs 22*a* and 22*b* between which the control fin constrained. Separation width of the stop tangs 22*a* and 22*b* provides clearance for normal control fin offset or minute uncontrolled motion during the constrained phase of the flight. As seen in FIG. 11, placement of the control fin stop assembly 18 on the booster 12 may be accomplished using a centering tool 44 in which a trailing edge 46 of the control fin 16 is received, the centering tool 44 in turn being received between the stop tangs 22*a* and 22*b*. Match drilling of bores for bolts 26 may be accomplished with the centering tool in place or with bolts employing self centering devices, the bolts may be tightened with the centering tool in place for exact positioning of the control fin stop assembly 18. As seen in FIG. 12, with the centering tool 44 removed after assembly, the trailing edge 46 of control fin 16 is substantially centered between the stop tangs 22*a* and 22*b*. However, stop tang 22*a* prevents unconstrained upward motion of the control fin 16 by contacting a top surface 48 of the control fin and stop tang 22*b* prevents unconstrained downward motion of the control fin by contacting a bottom surface 50 of the control fin. As seen in FIG. 13, the control fin stop assembly 18 positions the stop tangs 22 sufficiently outboard of the surface mold lines of the booster 12 and primary vehicle 14 to assure engagement of an inboard portion of the trailing edge 46 of fin 16.

Figure 14:
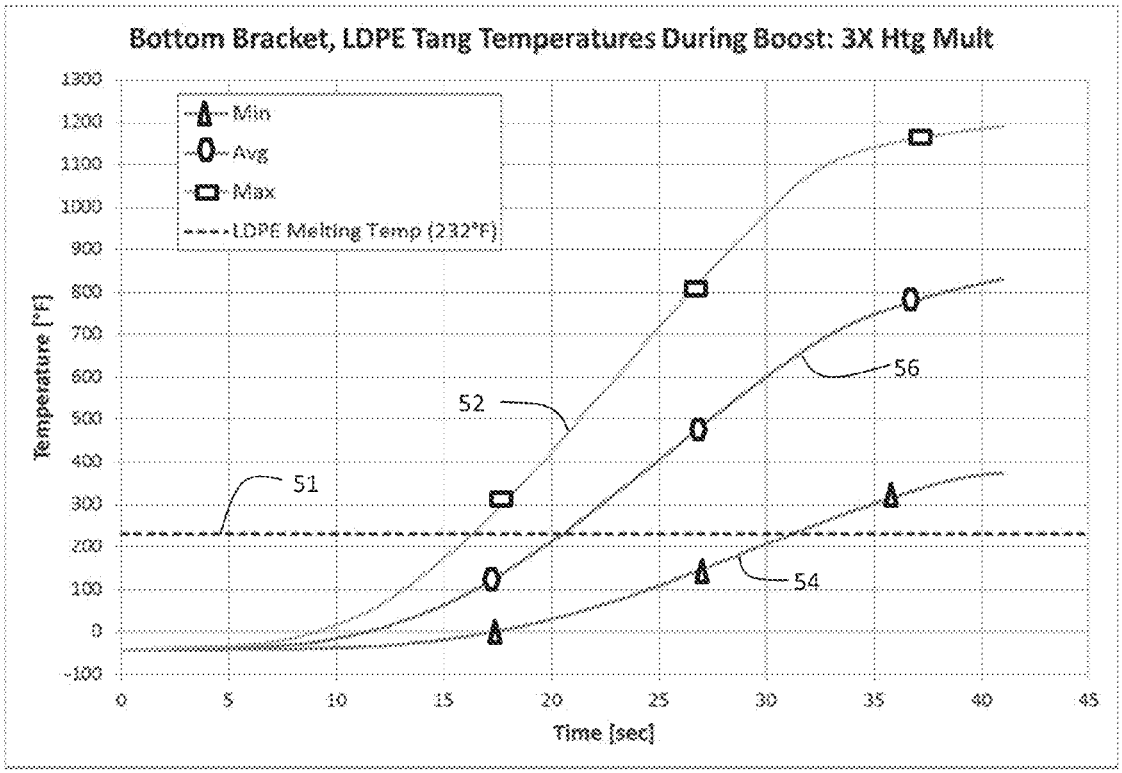
FIG. 14 is a graphical representation of exemplary aerodynamic heating for ablative erosion of the stop tangs.

In operation, the air vehicle 10 is carried aloft by a B-52 or comparable carrier aircraft and launched at a predetermined altitude. Typical temperature of the exterior of the air vehicle 10 and control fin stop assembly is approximately −30° F. during prelaunch carry at altitude as represented in FIG. 14. A primary function of the control fin stop assembly is to prevent undesired control fin movement during the launch sequence and immediately after launch to assure clean separation from the carrier aircraft. The structural strength requirements for the stop tang material at prelaunch conditions must be sufficient to withstand uncommanded control fin forces if the control fin actuator is inadvertently unlocked and the actuator is in the unpowered or passive condition. Upon launch, the air vehicle 10 accelerates rapidly providing significant aerodynamic heating. Material selection for the stop tangs 22 is also made based on desired ablative erosion of the stop tang heads 36 within the acceleration time of the air vehicle prior to separation of the booster 12 from the primary air vehicle 14 to allow unconstrained motion of the control fin upon separation.

Figure 15:
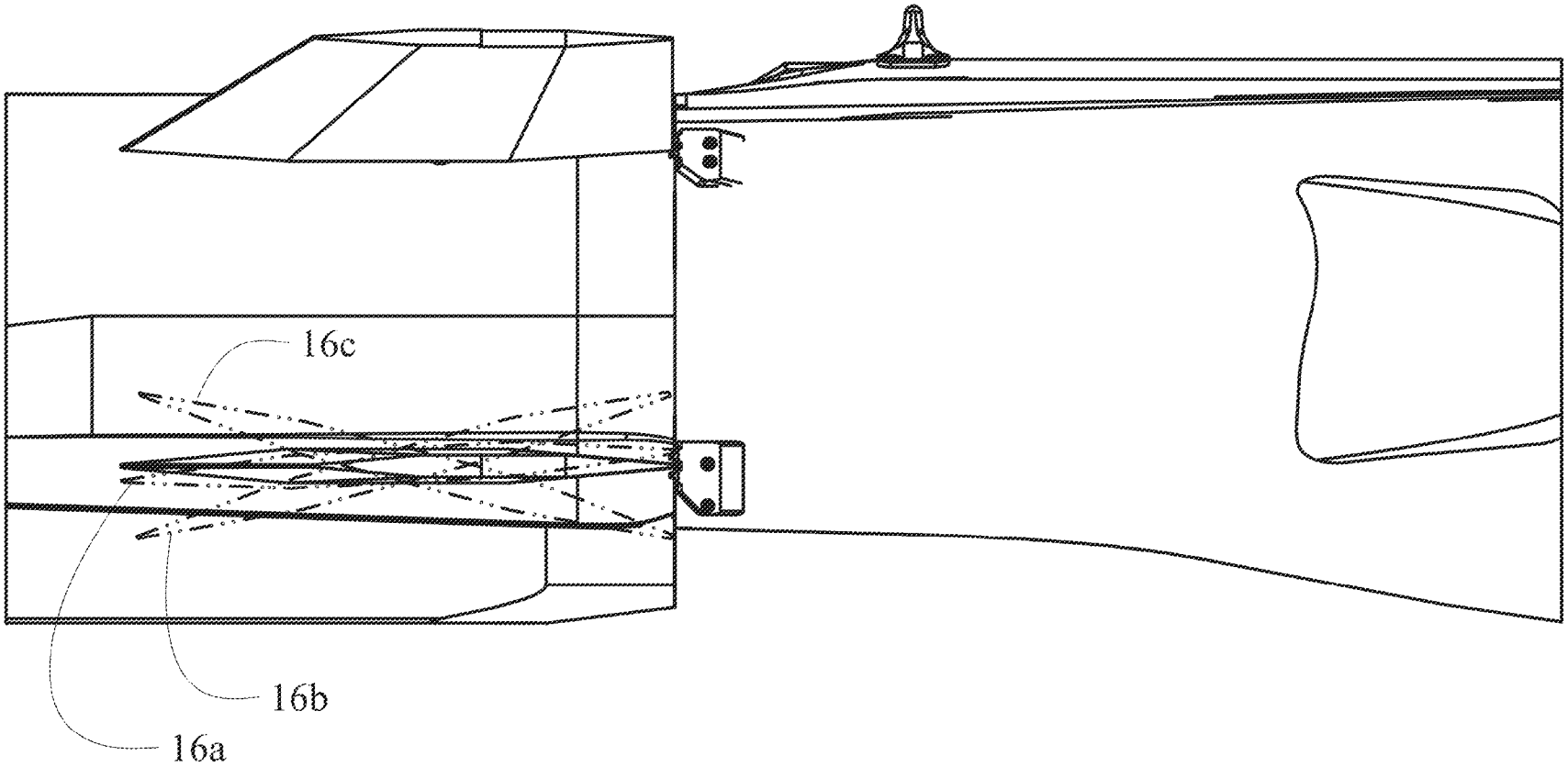
FIG. 15 is a side view of the air vehicle showing range of motion of the control fin for shearing of the uneroded material of the stop tangs; and, FIG. 16 is a flow chart depicting the method for fin control using the disclosed embodiments as a control fin stop assembly.

Thermoplastic materials provide the desired combination of low temperature strength and desirable melting temperature for ablative erosion of the tang head. In one exemplary embodiment, low density polyethylene (LDPE) is employed as the stop tang material. Alternative materials employed in various embodiments may include High Density Polyethylene (HDPE), Polypropylene (PP), Polystyrene, Polyvinyl Chloride (PVC), Acrylonitrile Butadiene Styrene (ABS), Ionomer (Surlyn) or Acetal Polymethyl Methacrylate (PMMA). LDPE has a melting temperature of 232° F. as shown in FIG. 14 by trace 51. The LDPE stop tangs attain the melting temperature due to aerodynamic heating at between approximately 16 and 31 seconds after launch as shown by traces 52 and 54 with an average of approximately 21 seconds as shown by trace 56. For an LDPE embodiment of the stop tangs having a neck area of 0.302 $in^2$, a reaction surface extending 0.148 inches beyond a neck width of 0.151 inches normal unpowered control fin forces of 121 lbs could be sustained at the launch temperature conditions. However in the event of lack of ablative erosion, actuator movement of the control fin in the powered condition occurring approximately 27 seconds after launch with an initial trim of 3° as shown in FIG. 15 with fin position 16*a* or controlled actuation from unconstrained positive to negative control fin positions at approximately 29.8 seconds after launch as shown by fin position 16*b* and 16*c* respectively results in forcible contact with sufficient shear force to shear the stop tang neck at a predetermined load for free control fin movement upon separation of the primary air vehicle 14 and booster 12.

Figure 16:
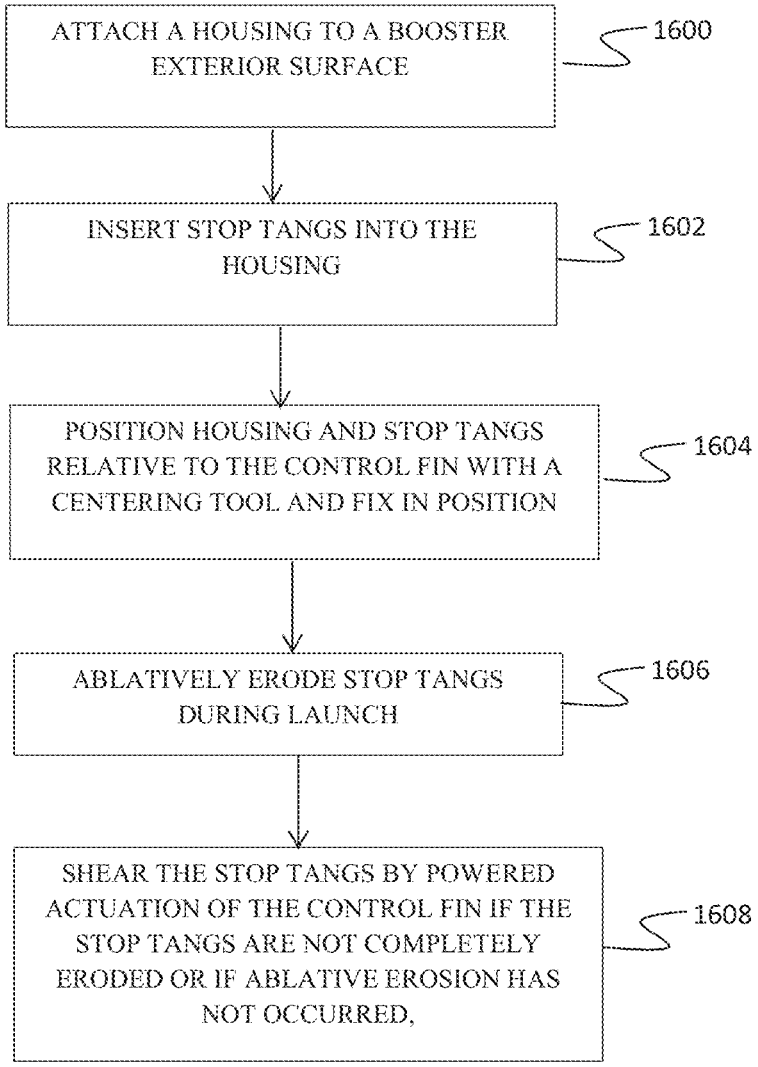

As represented in FIG. 16, the embodiments disclosed provide a method for constraining an unpowered control fin on a flight vehicle by attaching a housing to a booster exterior surface, step 1600 and inserting stop tangs into the housing, step 1602, which extend for contact with the control fin. The housing and stop tangs may be positioned relative to the control fin with a centering tool and fixed in position, step 1604. During launch, the stop tangs are ablatively eroded, step 1606, to allow unconstrained motion of the control fin. If the stop tangs are not completely eroded or if ablative erosion has not occurred, shearing of the stop tangs is accomplished by powered actuation of the control fin, step 1608.

Having now described various embodiments of the invention in detail as required by the patent statutes, those skilled in the art will recognize modifications and substitutions to the specific embodiments disclosed herein. Such modifications are within the scope and intent of the present invention as defined in the following claims.

What is claimed is:

1. A temporary control fin stop comprising:

a housing coupled to a vehicle;

two tangs coupled to the housing, a first tang positioned to engage an upper surface of a fin trailing edge and a second tang positioned to engage a lower surface of the fin trailing edge, said first tang and second tang ablatively erodible at a predetermined temperature induced by a flight profile of the vehicle, the housing incorporating a first shaped cutout receiving the first tang and a second cutout receiving the second tang.

2. The temporary control fin stop as defined in claim 1 wherein the first tang and second tang are frangible at a predetermined load exerted by the fin after launch.

3. The temporary control fin stop as defined in claim 1 wherein the first tang and second tang are fabricated from a thermoplastic material.

4. The temporary control fin stop as defined in claim 3 wherein the first tang and second tang are fabricated from low density polyethylene.

5. The temporary control fin stop as defined in claim 3 wherein the first tang and second tang are fabricated from material selected from a set consisting of High Density Polyethylene (HDPE), Polypropylene (PP), Polystyrene, Polyvinyl Chloride (PVC), Acrylonitrile Butadiene Styrene (ABS), Ionomer (Surlyn) or Acetal Polymethyl Methacrylate (PMMA).

6. The temporary control fin stop as defined in claim 1 wherein each cutout is trapezoidally shaped to retain a body of the tang and each tang includes a head extending from the body past the housing to contact the fin trailing edge in a passive condition.

7. The temporary control fin stop as defined in claim 6 wherein a neck between the body and head has an area providing a predetermined shear strength to allow the head to frangibly separate from the body upon powered activation of the fin urging the fin trailing edge into forcible contact with the head.

8. The temporary control fin stop as defined in claim 6 wherein the head has a reaction surface extending past an interface for engagement of a forward surface of the housing adjacent the cutout.

9. The temporary control fin stop as defined in claim 6 wherein the head has a blunt forward end.

10. The temporary control fin stop as defined in claim 6 wherein the head is tapered.

11. A method for constraining an unpowered control fin on a flight vehicle comprising:

attaching a housing to a booster exterior surface;

inserting two stop tangs into the housing to extend for contact with a control fin, wherein a first tang of the two stop tangs is positioned to engage an upper surface of a trailing edge of the control fin and a second tang of the two stop tangs is positioned to engage a lower surface of the trailing edge, the housing incorporating a first shaped cutout receiving the first tang and a second cutout receiving the second tang; and, ablatively eroding the stop tangs within an acceleration time of an air vehicle prior to separation of the booster from the air vehicle to allow unconstrained motion of the control fin upon separation.

12. The method of claim 11 further comprising:

shearing of the stop tangs by powered actuation of the control fin if the stop tangs are not completely eroded prior to separation.

13. The method of claim 11 further comprising:

positioning the housing and stop tangs relative to the control fin with a centering tool; and, fixing the housing in position.

14. A method for fabrication of a temporary control fin stop comprising:

providing a housing;

forming a pair of stop tangs having a blunt end and associated volume to be ablatively erodible at a predetermined temperature induced within an acceleration time to separation of a booster from a vehicle;

inserting the pair of stop tangs into the housing, wherein a first tang of the pair of stop tangs is positioned to engage an upper surface of a trailing edge of a control fin and a second tang of the pair of stop tangs is positioned to engage a lower surface of the trailing edge, the housing incorporating a first shaped cutout receiving the first tang and a second cutout receiving the second tang; and, attaching the housing to an exterior surface of the booster.

15. The method for fabrication of a temporary control fin stop as defined in claim 14 further comprising selecting a thermoplastic material for the stop tangs.

16. The method for fabrication of a temporary control fin stop as defined in claim 15 wherein the thermoplastic material is selected from a set consisting of low density polyethylene (LDPE), High Density Polyethylene (HDPE), Polypropylene (PP), Polystyrene, Polyvinyl Chloride (PVC), Acrylonitrile Butadiene Styrene (ABS), Ionomer (Surlyn) Acetal Polymethyl Methacrylate (PMMA).

17. The method for fabrication of a temporary fin stop control as defined in claim 14 further comprising forming a cutout for each stop tang to receive the stop tangs.

18. The method for fabrication of a temporary control fin stop as defined in claim 17 wherein the cutout is trapezoidal in shape and each stop tang has a trapezoidal body received in the cutout.

* * * * *